US008264911B2

(12) United States Patent
Ferrari

(10) Patent No.: US 8,264,911 B2
(45) Date of Patent: Sep. 11, 2012

(54) UNIVERSAL WRISTWATCH AND RELEVANT TIME SETTING SYSTEM IN TWELFTHS AND TWENTY-FOURTHS ACCORDING TO THE DIFFERENT TIME ZONE

(75) Inventor: Ruggero Ferrari, Parma (IT)

(73) Assignee: Marisa Marchignoli, Parma (IT)

( * ) Notice: Subject to any disclaimer, the term of this patent is extended or adjusted under 35 U.S.C. 154(b) by 0 days.

(21) Appl. No.: 12/527,599

(22) PCT Filed: Feb. 20, 2007

(86) PCT No.: PCT/IT2007/000116

§ 371 (c)(1),
(2), (4) Date: Aug. 18, 2009

(87) PCT Pub. No.: WO2008/102385

PCT Pub. Date: Aug. 28, 2008

(65) Prior Publication Data

US 2009/0323477 A1 Dec. 31, 2009

(51) Int. Cl.
*G04B 19/24* (2006.01)

(52) U.S. Cl. ..... 368/28; 368/21

(58) Field of Classification Search ..... 368/27, 368/21–22

See application file for complete search history.

(56) References Cited

U.S. PATENT DOCUMENTS

| | | | | |
|---|---|---|---|---|
| 723,489 | A * | 3/1903 | Rosenbusch | 368/27 |
| 811,585 | A * | 2/1906 | Pheils | 368/27 |
| 2,056,038 | A * | 9/1936 | De Angelis et al. | 368/27 |
| 2,128,970 | A * | 9/1938 | Smyser et al. | 368/15 |
| 2,615,298 | A * | 10/1952 | Ferrari | 368/27 |
| 2,641,898 | A * | 6/1953 | Galley | 368/27 |
| 5,323,363 | A * | 6/1994 | Hysek et al. | 368/21 |
| 5,524,102 | A * | 6/1996 | Liao et al. | 368/21 |
| 5,745,440 | A * | 4/1998 | Chen | 368/27 |
| 7,518,956 | B1 * | 4/2009 | Hansel | 368/15 |
| 2005/0207281 | A1 | 9/2005 | Geyer | |

FOREIGN PATENT DOCUMENTS

| | | |
|---|---|---|
| EP | 0 488 114 | 6/1992 |
| EP | 1 058 166 | 12/2000 |
| FR | 940.228 | 12/1948 |

OTHER PUBLICATIONS

International Search Report dated Oct. 4, 2007, from corresponding PCT application.

* cited by examiner

*Primary Examiner* — Sean Kayes
(74) *Attorney, Agent, or Firm* — Young & Thompson

(57) ABSTRACT

A universal wristwatch and relevant system for setting the time according to the time zone, the wristwatch (1) including concentric dials (A, B, C) showing the 24 hours (dial B), the 24 time zones (dial C) and the minutes (winder A) and including also selecting devices (11) suitable to implement a temporary connection between the rotation of the time zone dial (C) and the 24-hour dial (B) in order to realize an identical synchronous rotation further to which it will be possible to set the hour hand (O) on the new place thus obtaining independently and at the same time the collimation with the joint unit of dials (B) and (C). Once the collimation is completed, the previous different rotation of dials (B) and (C) is restored. The wristwatch (1) showing the time of the current time zone in twelfths and twenty-fourths, universal wristwatch, in addition to the other 23 places.

3 Claims, 2 Drawing Sheets

UNIVERSAL WRISTWATCH AND RELEVANT TIME SETTING SYSTEM IN TWELFTHS AND TWENTY-FOURTHS ACCORDING TO THE DIFFERENT TIME ZONE

BACKGROUND OF THE INVENTION

The present invention deals with a universal wristwatch and the relevant time setting system in twelfths and twenty-fourths according to the new time zone.

DESCRIPTION OF THE RELATED ART

A prior art example is described in the Swiss patent N. CH260633. This is one of the foremost patent that has realised fundamental innovations in the field of universal wristwatches, such as:

- time graduation 1-24 h with clockwise numbering and rotation, double planisphere rotation with all the 24 time zones, still with clockwise rotation, and
- setting at the centre of the clock (for the 24 time zones) the South Pole instead of the North Pole, as unsuitably proposed by some clock makers.

The solution proposed was yet, at that time revolutionary, and it has been implemented in the course of the years.

The solution proposed, at that time and all the solutions implemented at present, however, have not evolved since they are still stopped at incomplete solutions and not adequate to have a satisfactory time overview.

More particularly the solutions adopted up to now do not meet the requirements of the modern traveller which, due to present-day globalisation and speediness of the means of transport and communication, needs to know exactly the time in other parts of the globe and to set properly his/her wristwatch each time the time zone changes in order to be synchronised with local clocks.

A universal wristwatch like those implemented up to now shows the inconvenience to be steadily conditioned by the time zone where it is lying: for all the other time zones there will be, as usual, two separate and independent clocks.

SUMMARY OF THE PRESENT INVENTION

An object of the present invention is removing the above mentioned inconveniences by means of devices suitable to promptly enable the normal 1-12 wristwatch to show, wherever it may be on earth, the time both in twelfths and in twenty-fourths, at the same time and together with the time of the other 23 time zones.

In this way, the wristwatch is always both normal and universal, wherever it may be.

It makes no matter either the time zone where you are or the time zone where you have to go: with the system object of the present invention it will be possible to intervene immediately on the hour hand winder.

These objects and advantages are all obtained by the universal wristwatch subject of the present invention.

BRIEF DESCRIPTION OF THE DRAWINGS

This and other characteristics will be better pointed out by the following description of some embodiments shown, merely as a non-limiting example, in the enclosed tables of drawing in which.

DESCRIPTION OF THE PREFERRED EMBODIMENTS

Figure 1:
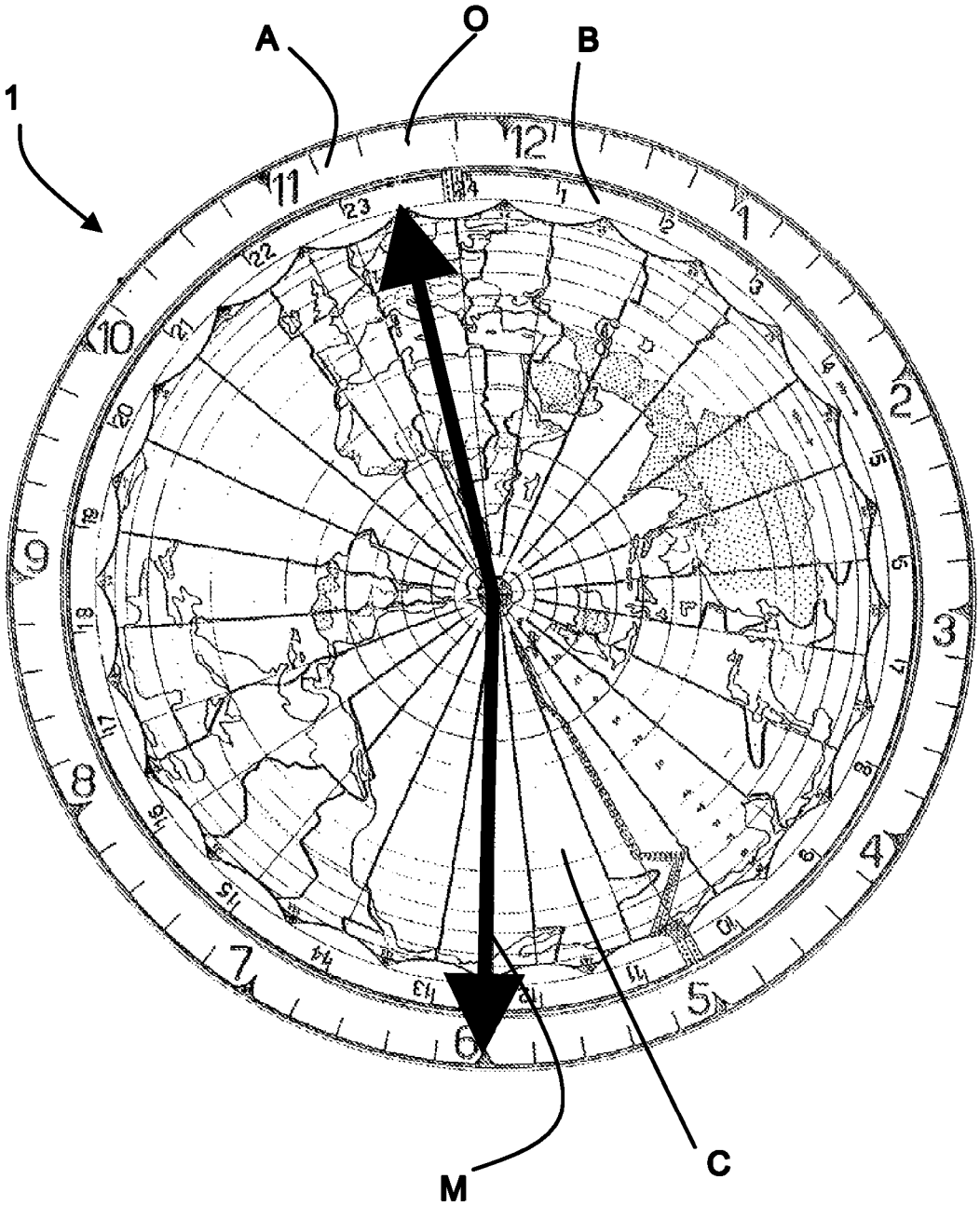
FIG. 1 is a front view of a universal wristwatch subject of the present invention.

With reference to FIG. 1, reference numeral 1 designates a universal wristwatch in its whole, which in addition to time (1 to 12 h), like common wristwatches, shows also the time of every time zone as well as the day of every time zone with respect to the day of the local time zone.

The universal wristwatch 1 includes:

1. an outer fixed winder A graduated in 12 hours and 60 minutes like in common wristwatches, that shows hours and minutes,
2. a smaller 24-hour graduated dial B with internal and concentric numbering increasing clockwise and making one complete turn clockwise in 24 hours;
3. a dial C completing clockwise two turns a day, concentric and internal to the above two graduations A and B; on the surface of this dial C being represented a planisphere with the South Pole in the middle, or as an alternative only twenty-four or forty-eight places, provided with 24 equidistant peripheral hands showing the time of the 24 time zones in which the planisphere is subdivided.
4. an hour hand O, completing two turns clockwise in 24 hours,
5. an minute hand M, completing one turn clockwise in 1 hour, shows the minutes, identical for all time zones.

The above mentioned dials A, B, C are concentric: as stated the first dial is fixed whereas the other two dials rotate around shaft D of minutes M clockwise: dial B makes one complete turn in 24 hours and dial C makes two turns in the 24 hours like the common hour hand O.

In this way, the planisphere makes two complete turns with respect to the fixed graduation (designated with A) and just one turn with respect to dial B; this enables to obtain for the time zone of interest the time indication in twelfths and twenty-fourths like in common watches and also to make use of the wristwatch like a universal watch.

With the present invention, when changing time zone it is possible to intervene by setting the hour hand O for the new time zone in order to be always informed about local time and to have automatically, independently and at the same time the universal indication of the other time zones by means of the time zone dial, i.e., dial C.

In fact, the wristwatch 1 subject of the present invention comprises suitable devices for connecting temporarily the rotation of the time zone dial C with the hour dial B, dial (1-24), in order to realize an identical synchronous rotation.

Then, setting the hour hand to the new required place will obtain, at the same time and independently, the collimation of the single unit "dial 1-24+time zone dial" on the aforesaid new place.

Once the above mentioned collimation is completed, repositioning the aforesaid devices to the original configuration will restore the previous different rotation of dials B and C.

Figure 2:
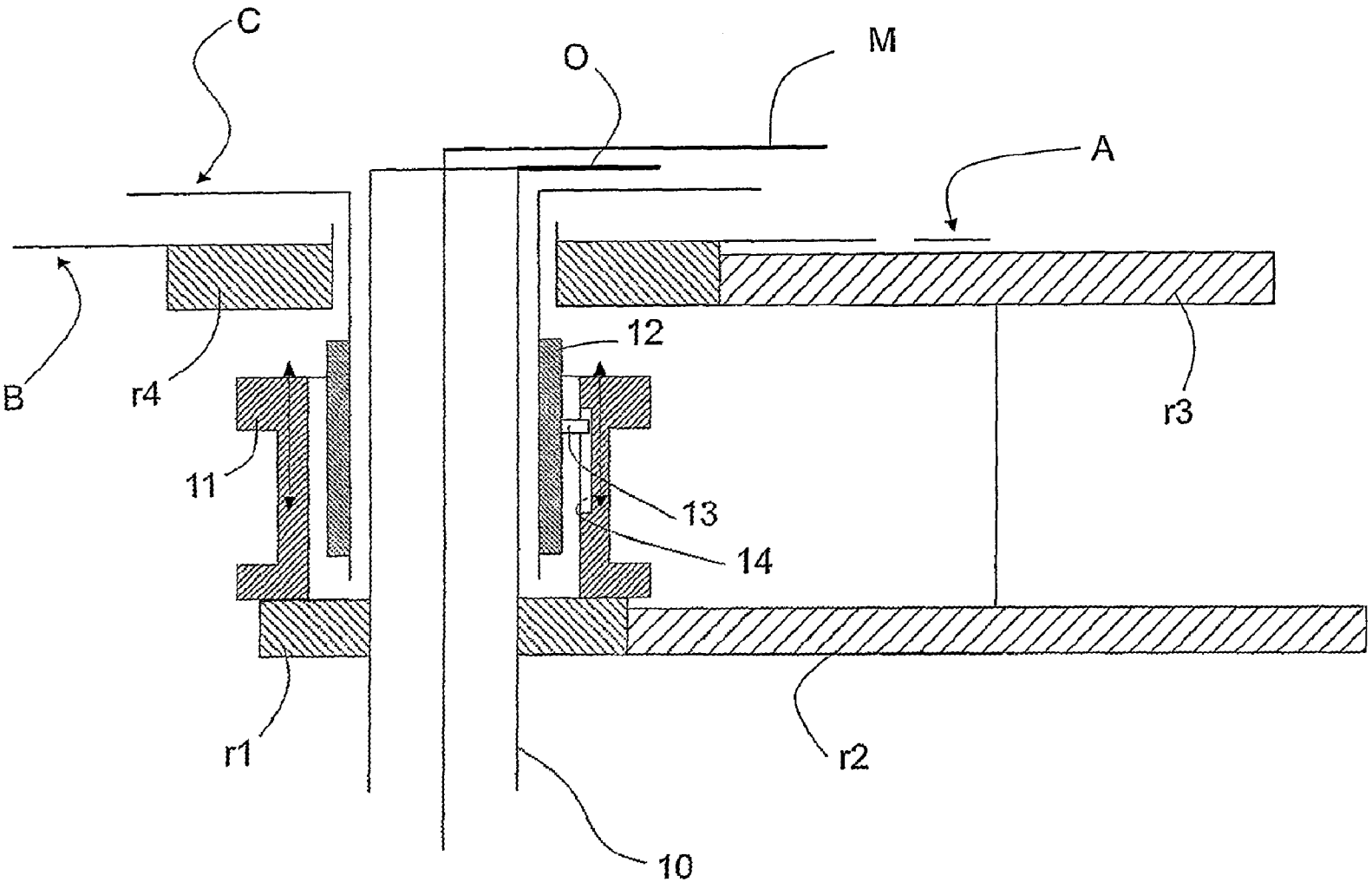
FIG. 2 is a conventional representation of the system for setting the rotation of the dials of the universal wristwatch subject of the present invention.

With reference to FIG. 2, a preferred system representation is shown, with the devices suitable to connect temporarily the dials B and C.

More particularly the hour shaft 10 is shown, which transmits by gear kinematic chain r1, r2, r3, r4 motion to dial B, being the gear r4 integral with it; gear ratio is 2:1, i.e.: to each turn of the shaft 10 corresponds a half turn of the dial B (the 1-24 hour dial).

The time zone dial C is coupled to the shaft 10 by means of the coupling 12 which is turned by the coaxial and external selector 11 through the sliding pin 13 and engaged in the groove 14.

In a typical operation configuration the selector 11 is connected to gear r1, thereby to each turn of the shaft 10 (therefore of the hours O and minutes M) corresponds a turn of the time zone dial C, thus confirming the ratio 2:1 between dials B and C.

When changing time zone, using the proper button or mechanism it will be possible to intervene on the selector 11 by disconnecting it from the coupling with r1 and setting it close to r4 in order to implement a temporary connection between the rotation of the time zone dial C and the 1-24 hour dial B. It will then be possible by clockwise or counter-clockwise rotation according to the new time zone, to set the hour hand O on the new place thus obtaining independently and at the same time the collimation with the joint unit of dials B and C.

Operating again the selector 11 and restoring the coupling with r1 will restore the original operating situation with the aforesaid ratios.

Since the minute hand M makes one complete turn in 60 minutes whereas the hour hand O, and therefore the shaft 10, make a feed of 15° (360/24) at every complete turn of the minute hand M, a suitable kinematic chain will be implemented to obtain said ratio between the components—embodiment not shown since self-evident.

The example refers to a mechanical combination suitable to realise the time setting system as described in the claims which follow, all equivalent implementations are nevertheless subject to the scope of the invention.

The invention claimed is:

1. A universal wristwatch (1), comprising:

an outer fixed winder (A) graduated in both twelve (12) hours and 60 minutes that shows hours and minutes;

a smaller 24-hour graduated dial (B) with internal and concentric numbering increasing clockwise and making one complete turn clockwise in 24 hours;

an inner time zone dial (C) completing clockwise two turns a day, concentric and internal to the winder (A) and the 24-hour graduated dial (B);

a planisphere represented on a surface of the time zone dial (C) with the South Pole in the middle;

twenty-four (24) equidistant peripheral hands subdividing the planisphere and showing a time of each of twenty-four (24) corresponding time zones in which the planisphere is subdivided;

an hour hand (O) mounted on an hour shaft (10), the hour hand completing two turns clockwise in 24 hours;

a minute hand (M), completing one turn clockwise each hour, the minute hand showing the minutes, identical for all time zones;

a gear kinematic chain (r1, r2, r3, r4), wherein the hour hand (O) rotates by the hour shaft (10), and the hour shaft (10) transmits by the gear kinematic chain (r1, r2, r3, r4) motion to 24-hour graduated dial (B), one gear (r4) of the gear kinematic chain being integral with said 24-hour graduated dial (B) with a gear ratio of 2:1, so that to each turn of the hour shaft (10) corresponds a half turn of the 24-hour graduated dial (B);

a coupling (12), wherein the time zone dial (C) is coupled to the hour shaft (10) by the coupling (12); and a coaxial and external selector (11), wherein the coupling (12) is turned by the selector (11) through a sliding pin (13) which extends from the coupling (12) and engages in a groove (14) of the selector (11), said selector (11) being connectable to another gear (r1) of the gear kinematic chain, wherein each turn of the hour shaft (10) corresponds to a turn of the time zone dial (C), confirming the ratio 2:1 between the 24-hour graduated dial (B) and the time zone dial (C), said selector (11) being detachable from said coupling with the another gear (r1) and settable to the one gear (r4) in order to implement a connection between the rotation of the time zone dial (C) and the 24-hour graduated dial (B).

2. A setting system for a universal wristwatch (1), the setting system comprising:

an outer fixed winder (A) graduated in both twelve (12) hours and 60 minutes that shows hours and minutes;

a smaller 24-hour graduated dial (B) with internal and concentric numbering increasing clockwise and making one complete turn clockwise in 24 hours;

an inner time zone dial (C) completing clockwise two turns a day, concentric and internal to the winder (A) and the 24-hour graduated dial (B);

a planisphere represented on a surface of the time zone dial (C) with the South Pole in the middle;

twenty-four (24) equidistant peripheral hands subdividing the planisphere and showing a time of each of twenty-four (24) corresponding time zones in which the planisphere is subdivided;

an hour hand (O) mounted on an hour shaft (10), the hour hand completing two turns clockwise in 24 hours;

a minute hand (M), completing one turn clockwise each hour, the minute hand showing the minutes, identical for all time zones;

a gear kinematic chain (r1, r2, r3, r4), wherein the hour hand (O) rotates by the hour shaft (10), and the hour shaft (10) transmits by the gear kinematic chain (r1, r2, r3, r4) motion to 24-hour graduated dial (B), one gear (r4) of the gear kinematic chain being integral with said 24-hour graduated dial (B) with a gear ratio of 2:1, so that to each turn of the hour shaft (10) corresponds a half turn of the 24-hour graduated dial (B);

a coupling (12), wherein the time zone dial (C) is coupled to the hour shaft (10) by the coupling (12); and a coaxial and external selector (11), wherein the coupling (12) is turned by the selector (11) through a sliding pin (13) which extends from the coupling (12) and engages in a groove (14) of the selector (11), said selector (11) being connectable to another gear (r1) of the gear kinematic chain, wherein each turn of the hour shaft (10) corresponds to a turn of the time zone dial (C), confirming the ratio 2:1 between the 24-hour graduated dial (B) and the time zone dial (C), said selector (11) being detachable from said coupling with the another gear (r1) and settable to the one gear (r4) in order to implement a connection between the rotation of the time zone dial (C) and the 24-hour graduated dial (B), wherein during said connection, the time zone dial (C) and the hour dial (B) realize an identical synchronous rotation for enabling to set the hour hand (O) on a new place and to obtain at a same time and independently collimation with the joint unit of the 24-hour graduated dial (B) and the time zone dial (C), thereby showing a local time in twelfths and twenty-fourths, the selecting devices (11) being repositionable to an original configuration, after completing the collimation, to thereby restore a previous ratio between the 24-hour graduated dial (B) and the time zone dial (C).

3. A universal wristwatch (1), comprising:

an outer fixed winder (A) graduated in both twelve (12) hours and 60 minutes that shows hours and minutes;

a smaller 24-hour graduated dial (B) with internal and concentric numbering increasing clockwise and making one complete turn clockwise in 24 hours;

an inner time zone dial (C) completing clockwise two turns a day, concentric and internal to the winder (A) and the 24-hour graduated dial (B);

a planisphere represented on a surface of the time zone dial (C) with the South Pole in the middle;

twenty-four (24) equidistant peripheral hands subdividing the planisphere and showing a time of each of twenty-four (24) corresponding time zones in which the planisphere is subdivided;

an hour hand (O) mounted on an hour shaft (10), the hour hand completing two turns clockwise in 24 hours;

a minute hand (M), completing one turn clockwise each hour, the minute hand showing the minutes, identical for all time zones;

a gear kinematic chain (r1, r2, r3, r4), wherein the hour hand (O) rotates by the hour shaft (10), and the hour shaft (10) transmits by the gear kinematic chain (r1, r2, r3, r4) motion to 24-hour graduated dial (B), one gear (r4) of the gear kinematic chain being integral with said 24-hour graduated dial (B) with a gear ratio of 2:1, so that to each turn of the hour shaft (10) corresponds a half turn of the 24-hour graduated dial (B);

a coupling (12), the coupling (12) comprising an extending pin (13), wherein the time zone dial (C) is coupled to the hour shaft (10) by the coupling (12); and a coaxial and external selector (11), the selector (11) comprising a groove (14), the extending pin (13) engaged in the groove (14), wherein the coupling (12) is turned by the selector (11) through the sliding pin (13) extending from the coupling (12) and engaged in the groove (14) of the selector (11), said selector (11) being connectable to another gear (r1) of the gear kinematic chain, wherein each turn of the hour shaft (10) corresponds to a turn of the time zone dial (C), confirming the ratio 2:1 between the 24-hour graduated dial (B) and the time zone dial (C), said selector (11) being detachable from said coupling with the another gear (r1) and settable to the one gear (r4) in order to implement a connection between the rotation of the time zone dial (C) and the 24-hour graduated dial (B).

* * * * *